United States Patent [19]

Herb

[11] Patent Number: 4,697,805

[45] Date of Patent: Oct. 6, 1987

[54] FOLDER WITH ROTATING GUIDE ROLLER AT FOLDING BLADE AND JAW CYLINDER EXIT

[75] Inventor: Rudolf Herb, Bobenheim, Fed. Rep. of Germany

[73] Assignee: Albert-Frankenthal AG, Frankenthal, Fed. Rep. of Germany

[21] Appl. No.: 835,200

[22] Filed: Mar. 3, 1986

[30] Foreign Application Priority Data

Apr. 4, 1985 [DE] Fed. Rep. of Germany ..... 3512308

[51] Int. Cl.[4] ..... B41C 1/04

[52] U.S. Cl. ..... 270/47; 493/424; 271/69

[58] Field of Search ..... 270/46–47, 270/49–50, 60, 21.1; 493/424, 425, 426, 428–429, 432, 359–360; 271/69

[56] References Cited

U.S. PATENT DOCUMENTS

| | | | |
|---|---|---|---|
| 1,450,574 | 4/1923 | Barber | 270/48 |
| 2,131,363 | 9/1938 | Barber | 270/47 |
| 2,138,054 | 11/1938 | Zuckerman | 270/47 |
| 2,164,370 | 7/1939 | Zuckerman | 270/47 |
| 3,774,907 | 11/1973 | Borostyan | 271/196 X |
| 4,344,610 | 8/1982 | Jeschke et al. | 270/47 |

FOREIGN PATENT DOCUMENTS

| | | | |
|---|---|---|---|
| 1132935 | 9/1958 | Fed. Rep. of Germany | 270/47 |
| 1350186 | 12/1963 | France | 270/47 |
| 691336 | 5/1953 | United Kingdom | 270/47 |

*Primary Examiner*—E. H. Eickholt

*Attorney, Agent, or Firm*—Collard, Roe & Galgano

[57] ABSTRACT

In a folder with at least one folding blade cylinder cooperating with a folding jaw cylinder, and with a guide mechanism which is located at each outlet wedge situated after the folding place in the direction of rotation of the respective cylinders cooperating in the folding process, extends over the entire length of the cylinder, and guides the parts of the sheets lying, after the folding place, on the circumferential section of the folding blade cylinder and being taken therefrom in the folding process, a long life of the guide mechanism as well as careful handling of the signatures to receive a cross fold can be guaranteed by the guide mechanism being equipped with a middle part which is so supported that it can turn freely around an axis parallel to the cylinder and has an approximately cylindrical surface, and with stationary connecting parts which join the said middle part laterally and have a surface contour cutting about tangentially into the surface of the middle part.

26 Claims, 3 Drawing Figures

FOLDER WITH ROTATING GUIDE ROLLER AT FOLDING BLADE AND JAW CYLINDER EXIT

BACKGROUND OF THE INVENTION

The present invention relates to a folder with at least one cylinder equipped with at least one folding blade and holding devices taking the signatures at their front edge which cooperates with a respective cylinder provided with folding jaws, a guide mechanism located at each outlet wedge situated after the folding place in the direction of rotation of the respective cylinders cooperating in the folding process extending over the entire length of the cylinder which guides the parts of the sheets lying, after the folding place, on the circumferential section of the folding blade, and being taken therefrom in the folding process.

A folder of this design is commonly known. The guide mechanism illustrated only schematically usually consists of single-part tongues which are stationary and arranged next to each other. Experience has proven that these stationary tongues, in particular in their middle section, are subjected to rapid wear. The reason for this wear is that the halves of the sheets of the individual signatures which run ahead on the folding blade cylinder and, when the signatures are conveyed to the folding jaw cylinder, are jerkily accelerated opposite to their original direction of motion, due to this process strongly lash outwards and thereby always strike particularly hard against certain places of the middle section of the tongues forming the guide mechanism. The result is cavitation-like signs of wear in the form of hollows or break-offs respectively at the places struck. These local damages of the guide surface of the tongues forming the guide mechanism, which develop rapidly even after a relatively short period of use, may lead to damage of the signatures in the form of scratch marks, tears, smudged ink, etc., thus having an unfavorable effect on the quality of the final product. Therefore, it has been necessary heretofore to change the tongues at short maintenance intervals, which however results in high costs in maintenance and material and at the same time requires the machines to lie idle for quite a long time.

SUMMARY OF THE INVENTION

Taking this prior art into account, the object of the invention is therefore to avoid the shortcomings of previously proposed machines and provide a folder as mentioned at the beginning hereof, of which the guide mechanism has a long life and which nevertheless guarantees that the signatures are handled carefully.

In order to effect this object, the guide mechanism is equipped with a middle part which is so supported that it can turn freely around an axis parallel to the cylinder or cylinders and has an approximately cylindrical surface, and stationary connecting parts which join the said middle part on the side of the folding blade cylinder and the side of the folding jaw cylinder and have a surface contour running about tangentially into the surface of the middle part.

The invention conveniently ensures that the middle part, which is turningly supported and turned by the signatures brushing past, is worn on its entire surface. This avoids strong local signs of wear even though the middle part is considerably used. There rather ensues a practically even wear on the entire surface of the turningly supported middle part. This conveniently results in relatively long maintenance intervals. On the other hand, due to non-existing local cavitations etc., the signatures are handled more carefully than heretofore. The invention therefore has favoravble effcts on the utilization of the machine and the quality of the product and thus guarantees excellent economic efficiency.

As part of a convenient further development of the invention, the middle part of the guide mechanism may be in the form of a single-part roller. This results in a simple and compact design. At the same tinme, the surface is hereby as big as possible and a long life results.

The connecting parts may simply be in the form of profile sections, which also results in a relatively simple production.

In accordance with a further convenient development of the invention, the middle part and/or the connecting parts may be made of plastic, preferably ethylene tetrafluoride. The self-lubricating properties of the plastic surface result in the signatures being handled carefully. Moreover it is possible to have a surface with particularly little roughness, which also results in a careful handling of the signatures.

As part of a further development of the invention, the middle part and the connecting parts may be accommodated on a frame which can be attached to the machine frame and has two lateral bearing blocks accommodating the middle part and being connected with each other by support rails to which the connecting parts can be fixed. This invention makes sure that the guide mechanism can be completely preassembled and conveniently adjusted in its entirety, as for example simply by turning the frame. When the guide mechanism is to be changed, which from time to time cannot be avoided, the invention also enables the complete assembly to be removed and replaced by a new one, which can be done within a short period of time so that a favorable effect on the utilization of the machine results.

Other objects and features of the present invention will become apparent from the following detailed description considered in connection with the accompanying drawings. It is to be understood, however, that the drawings are designed as an illustration only and not as a definition of the limits of the invention.

BRIEF DESCRIPTION OF THE DRAWINGS

In the drawings, wherein similar reference characters denote similar elements throughout the several views.

DETAILED ACCOUNT OF THE PREFERRED EMBODIMENT

Figure 1:
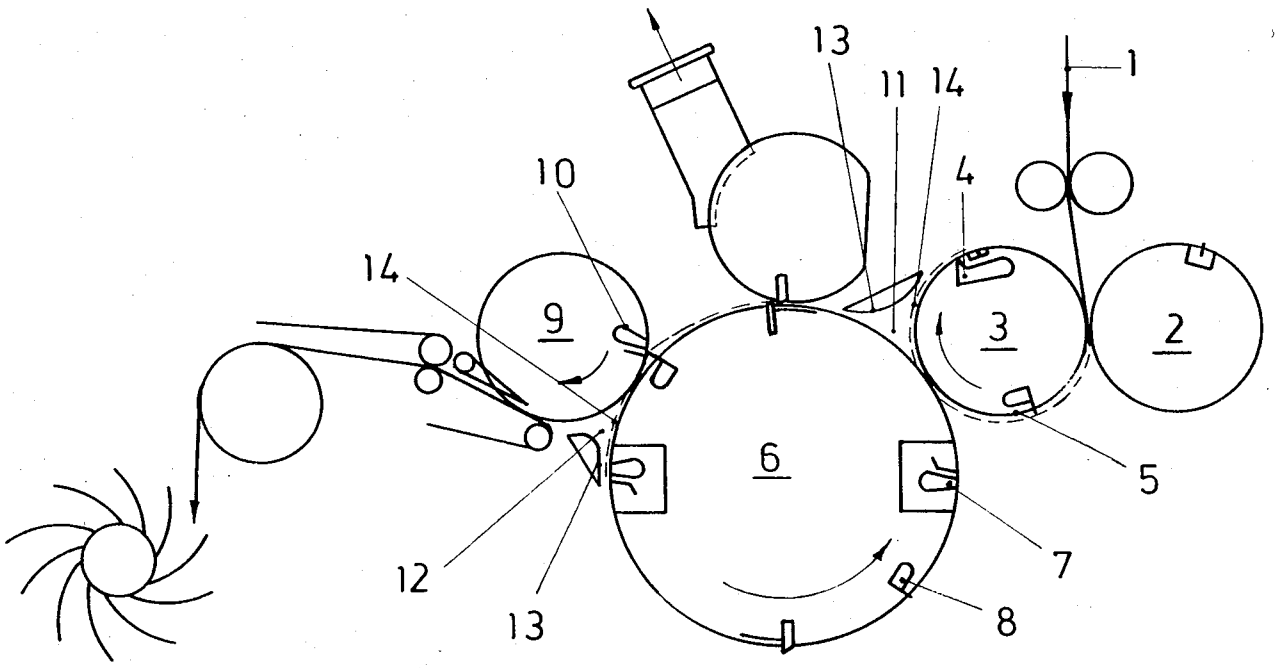
FIG. 1 is a schematic side view of a folder.

The folder shown in FIG. 1 contains a cross cutting device for dividing a web of paper 1 into signatures, and two cross folding devices for folding these signatures around a folding line parallel to their front edge. The cross cutting device consists of a blade located on a respective cylinder 2 and a cutting groove which cooperates with the said blade and is located on a cylinder 3 rolling on the cylinder 2. Point pins 4 cooperate with the said groove and dig into the front area of the beginning of the web of paper resulting from each cut. In order to place the first cross fold, the cylinder 3 is provided with a folding blade 5 which is staggered at 180° against the cutting groove and cooperates with folding jaws 7 located on a cylinder 6 rolling on the cylinder 3. If signatures with only one cross fold are to be produced, they are taken from the cylinder 6. In the illustrated working example the cylinder 6, for placing the second cross fold, is provided with folding blades 8 which are preceded by its folding jaws 7 and cooperate with a folding jaw 10 located on a further cylinder 9 rolling on the cylinder 6. The signatures with two cross folds are taken from the cylinder 9 by means of a lifting mechanism and conveyed to a belt system leading to a fan wheel.

At the outlet wedges 11 or respectively 12 each preceded by the cross folding place between the cylinders 3 and 6 which carry the folding blades 5 and folding jaws 7 cooperating at the place of the first cross fold, or respectively between the cylinders 6 and 9 which carry the folding blades 8 and folding jaws 10 cooperating at the place of the second cross fold, there is a guide mechanism 13 each which serves to convey the halves of the signatures 14 lying on the circumferential section of the respective cylinder 3 or respectively 6 preceding the cooperating folding blade 5 or respectively 8 to the cylinder 6 or respectively 9 carrying the folding jaws 7 or respectively 10 with the folding accomplished. These front halves of the signatures extremely lash radially outwards due to the jerky acceleration opposed to their original direction of motion, which may cause considerable stress on the guide mechanisms 13.

Figure 2:
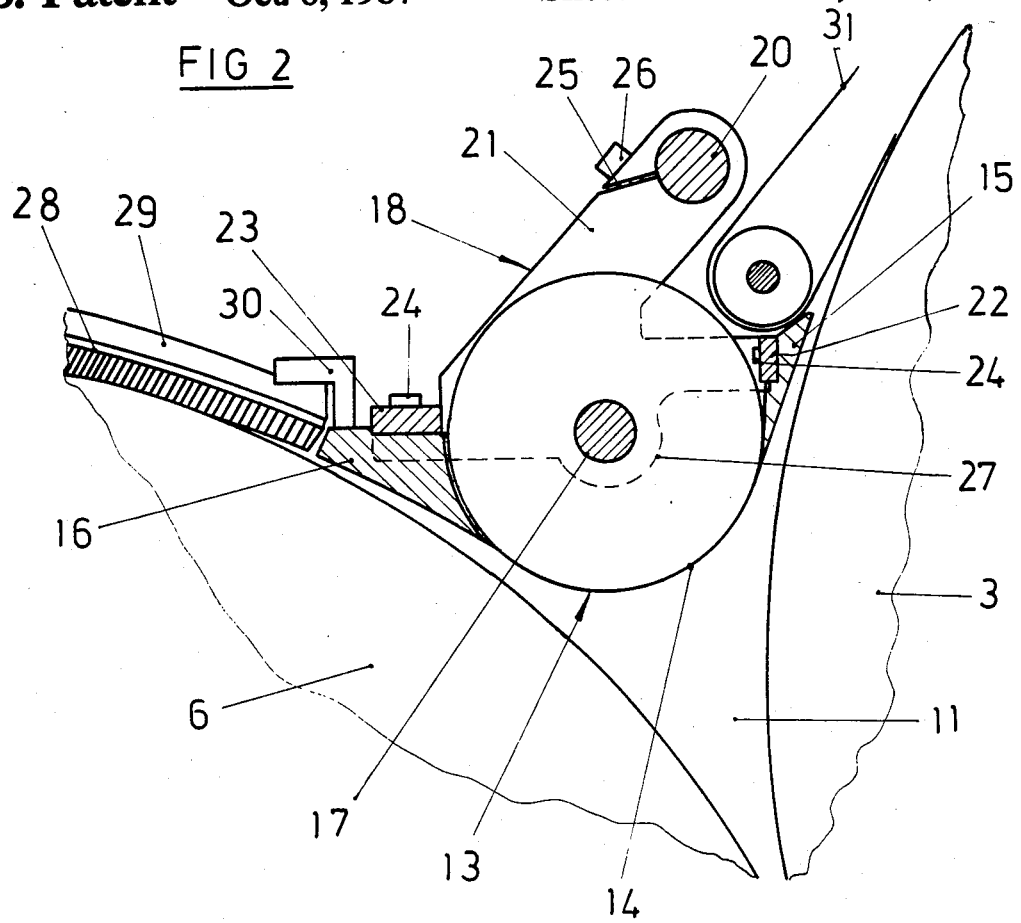
FIG. 2 is a radial cross-sectional view of the guide mechanism of the present invention.
Figure 3:
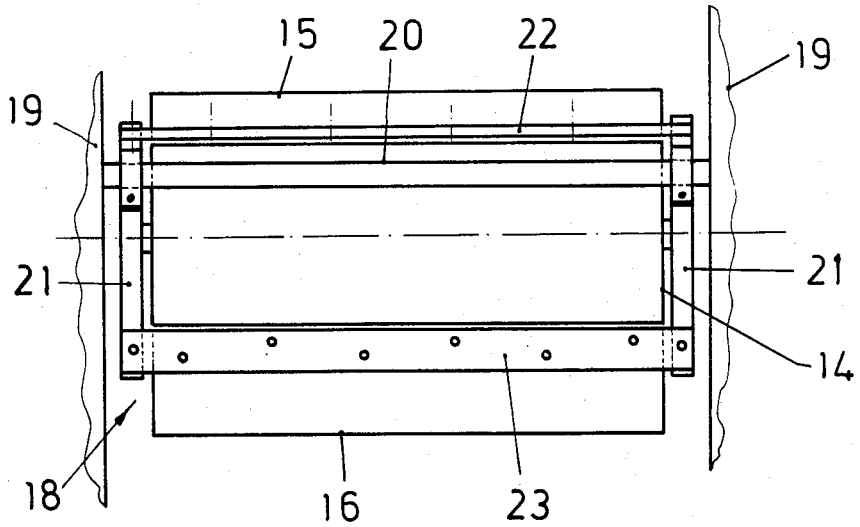
FIG. 3 is a top view of the guide mechanism shown in FIG. 2.

In order to guarantee a long life for guide mechanisms 13 however, the latter consist, as can clearly be seen in FIGS. 2 and 3, of a roller 14 which forms a middle part and is so supported that it can turn freely around an axis parallel to the cylinder, and of two stationary connecting parts 15 or respectively 16 which join the said roller 14 on the side of the cylinder and have a surface contour tangentially meeting the cylindrical surface of the roller 14. The guide mechanisms 13 being composed of several parts results in only the part concerned having to be changed in cases of wear. Moreover, the stress which wears particularly on the middle is here distributed onto the entire circumference of the roller as for forming the middle part a roller is used which rotates by the effect of the signatures brushing past. The surface of the roller 14 as well as the connecting parts 15, 16 are in the form of plastic castings, which, due to the self-lubricating properties of plastic, results in a particularly careful handling of the signatures. In order to make the air moved by the signatures hitting against the guide mechanisms 13 escape freely, the roller 14 and the connecting parts 15, 16 may be provided with grooves at their circumference or their guide surface respectively. Such a design also makes it possible to mortise the roller 14 and the connecting parts 15, 16 with each other with the projections of the roller 14 engaging with the grooves of the connecting parts 15, 16 and vice versa. It would also be feasible to have several rolls as for example accommodated on a mutual axis next to each other with a distance between them instead of one continuous roller provided with two lateral pivot pins 17. The connecting parts 15, 16 may also be formed by several tongues as for example placed next to each other with a distance between them. In the illustrated working example there is one continuous roller 14 provided with two lateral pivot pins 17, and connecting parts 15, 16 formed by continuous profile sections.

The roller 14 and the connecting parts 15, 16 may be supported on the machine frame separate from each other. In the illustrated working example the roller 14 and the lateral connectin parts 15, 16 are accommodated on a mutual frame 18. The latter, as can be best seen in FIG. 3, is located between the lateral walls of the frame and suspended therefrom. In the illustrated working example there is, for this purpose, a traverse 20 which extends over the entire width of the machine, is attached to the lateral walls 19 of the frame, and supports the frame 18. Instead of a continuous traverse there may of course also be two coaxial axle journals opposite each other.

The frame 18 consists of two lateral bearing blocks 21 which are rotatably supported on the traverse 20 and connected with each other by support rails 22, 23 placed outside the roller 14 and parallel to the axis. The bearing blocks 21 are provided with support holes cooperating with the pivot pins 17 of the roller 14. The connecting parts 15, 16 are attached to the support rails 22 or respectively 23 which extend over the entire width of the frame 18. In the illustrated working example, check screws 24 are provided for this purpose. In order to immobilize the frame 18 which is turningly supported on the traverse 20, the bearing blocks 21 are provided with a clamping slit 25 each and a respective clamping screw 26 at the holes penetrated by the traverse 20. The clamping screws 26 are tightened as soon as the turning position of the frame 18 called for is reached.

In the illustrated working example the bearing blocks 21 are provided with stationary supports 27 cooperating with the pivot pins 17 of the roller 14. In some cases, in order to make the support of the roller 14 adjustable, it may be appropriate to adjustably arrange the roller on the frame 18 so that there is the possibility of adjusting when the diameter of the roller decreases. For this purpose the lateral pivot pins 17 may engage with cooperating support shoes which are slidingly supported on the bearing blocks 21. The connecting parts 15, 16 may also be turningly or respectively adjustably supported on the frame 18. In most cases however, a fixed arrangement of the connecting parts 15, 16 as well as a stationary support of the roller 14 prove sufficient, as can be seen in the illustrated working example.

In the working example shown in FIG. 2, the downstream cylinder, in this case the cylinder 6, is, after the respective connecting part 16, embraced by a brush 28. For stabilizing reasons the brush 28 may be supported on the adjacent frame 18 with its end on the side of the frame. In the illustrated working example the bristle holder 29 of the brush 28 is for this purpose provided with a support claw 30 which fully rests on the backside of the adjacent connecting part 16. In the illustrated working example the support claw 30 is in the form of a rigid component. But it would also be possible to make the support claw 30 adjustable in case an adjustability of the brush 28 is called for as for continuously narrowing the gap.

The upstream cylinder 3 is, after the respective connecting part 15, embraced by a belt system 31. The latter joins the adjacent connecting part 15 virtually continously. The same holds true for the brush 28 which also joins the adjacent connecting part 16 continuously.

I claim:

1. A signature folder having at least one cylinder with at least one folding blade and holding devices for taking the signatures at their front edge, a further cylinder with folding jaws which cooperate with the folding blade of said folding blade cylinder during rotation of said cylinders, which cooperation defines a folding place for the signatures carried by said folding blade cylinder, means for rotating said cylinders, and a guide mechanism extending the length of said cylinders and disposed in the outlet wedge defined between said cylinders in the direction of rotation of said cylinders downstream from said folding place for guiding the parts of said signatures lying on the circumference of the folding blade cylinder and taken therefrom by the folding jaw of said folding jaw cylinder, the improvement comprising:

said guide mechanism including a middle part freely rotatable about an axis parallel to said cylinders and having an approximately cylindrically shaped surface, and stationary connecting parts having surface contours which run approximately tangentially into the surface of the middle part and which join said middle part at the sides thereof associated with the respective folding blade and folding jaw cylinders.

2. The folder claimed in claim 1 whereby the middle part of the guide mechanism is in the form of a roller provided with lateral pivot pins.

3. The folder claimed in claim 2 whereby the roller has over its length an uninterrupted surface.

4. The folder claimed in claim 1 whereby the connecting parts consist of solid sections.

5. The folder claimed in claim 1 whereby the middle part has grooves on the circumference thereof.

6. The folder claimed in claim 1 whereby the middle part is comprised of several parts located coaxially adjacent to each other without spaces therebetween.

7. The folder claimed in claim 1 whereby the middle part is, at least partially, made of plastic.

8. The folder claimed in claim 1 whereby the folder includes a machine frame and the middle part and the connecting parts are accommodated on a sub-frame attached to the machine frame, said sub-frame having two lateral bearing blocks accommodating the middle part and being connected with each other by support rails.

9. The folder claimed in claim 8 whereby the sub-frame is rotatably supported on the machine frame and is lockable in position by a locking device.

10. The folder claimed in claim 8 whereby the middle part is accommodated on the sub-frame by adjustment means.

11. The folder claimed in claim 8 whereby the cylinder provided with folding jaws is, downstream in the direction of rotation from the respective connecting part of the guide mechanism, embraced by a brush having an end facing the respective connecting part of the guide mechanism with support means for supporting it continuously on the respective connecting part.

12. The folder claimed in claim 1 which further includes in the direction of rotation of the folding blade cylinder downstream from the respective connecting part a belt system associated with said respective connecting part continuously.

13. The folder claimed in claim 1 whereby the connecting parts have grooves on the circumferences thereof.

14. The folder claimed in claim 1 whereby the middle part and the connecting parts have grooves on their circumferences.

15. The folder claimed in claim 1 whereby the connecting parts are each comprised of several adjacent parts without spaces therebetween.

16. The folder claimed in claim 1 whereby the middle part and connecting parts are each comprised of several parts located coaxially adjacent to each other without spaces therebetween.

17. The folder claimed in claim 6 wherein the several adjacent parts of the middle part are spatially separated.

18. The folder claimed in claim 5 wherein the several adjacent parts of the connecting parts are spatially separated.

19. The folder claimed in claim 16 wherein the several adjacent parts respectively of the middle part and the connecting parts are spatially separated.

20. The folder claimed in claim 1 whereby the connecting parts are, at least partially, made of plastic.

21. The folder claimed in claim 1 whereby the middle part and the connecting parts are, at least partially, made of plastic.

22. The folder claimed in claim 8 whereby the connecting parts are attached to said sub-frame.

23. The folder claimed in claim 22 whereby the middle part and connecting parts are accommodated on the sub-frame by adjustment means.

24. The folder claimed in claim 22 whereby the connecting parts are accommodated on the sub-frame by adjustment means.

25. The folder claimed in claim 11 whereby the support means for said brush supports the same on said sub-frame.

26. The folder claimed in claim 11 whereby the support means for said brush supports the same on the respective connecting part and the sub-frame.

* * * * *